United States Patent [19]

Fisher

[11] 3,970,024

[45] July 20, 1976

[54] MODULAR FLOATING LOAD-SUPPORTING ASSEMBLAGE

[76] Inventor: John A. Fisher, 2458 Red Apple Drive, Dayton, Ohio 45431

[22] Filed: Sept. 4, 1975

[21] Appl. No.: 610,392

[52] U.S. Cl. ..... 114/.5 F; 9/2 S; 9/11 R

[51] Int. Cl.[2] ..... B63B 35/72

[58] Field of Search ..... 114/.5 F, 43.5 R, 77, 114/28; 9/8 R, 2 S, 11 R; 61/48; 52/586; 46/24–26

[56] References Cited

UNITED STATES PATENTS

| | | | |
|---|---|---|---|
| 3,124,858 | 3/1964 | Blonde | 52/586 |
| 3,152,568 | 10/1964 | Mayer | 114/.5 F |

FOREIGN PATENTS OR APPLICATIONS

| | | | |
|---|---|---|---|
| 2,918 | 6/1883 | United Kingdom | 9/8 R |

*Primary Examiner*—Trygve M. Blix
*Assistant Examiner*—Sherman D. Basinger
*Attorney, Agent, or Firm*—Mason, Mason & Albright

[57] ABSTRACT

Modules composed of polymer foam blocks with impervious shells are individually provided with a continuous channel about the periphery of each module. Joined, a plurality of such modules form a load-supporting floating structure, the integrity of which is maintained by floatable bars which are fitted closely into the facing channels formed in adjacent modules to provide interconnections between the modules and a tension band which encircles the structure in outer aligned channels formed by the modules, channel bars of relatively rigid material being first fitted into such encircling aligned channels, which bars in turn receive the tension band. Optionally, a plurality of perimeter pieces may be provided at the circumference of the structure, each perimeter piece including a tongue fitting in adjacent aligned channels of the modules, an encircling channel being defined by the perimeter pieces which receives the tension band.

10 Claims, 15 Drawing Figures

FIG. 2
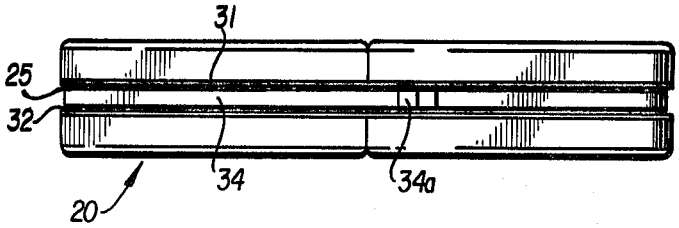
FIG. 3
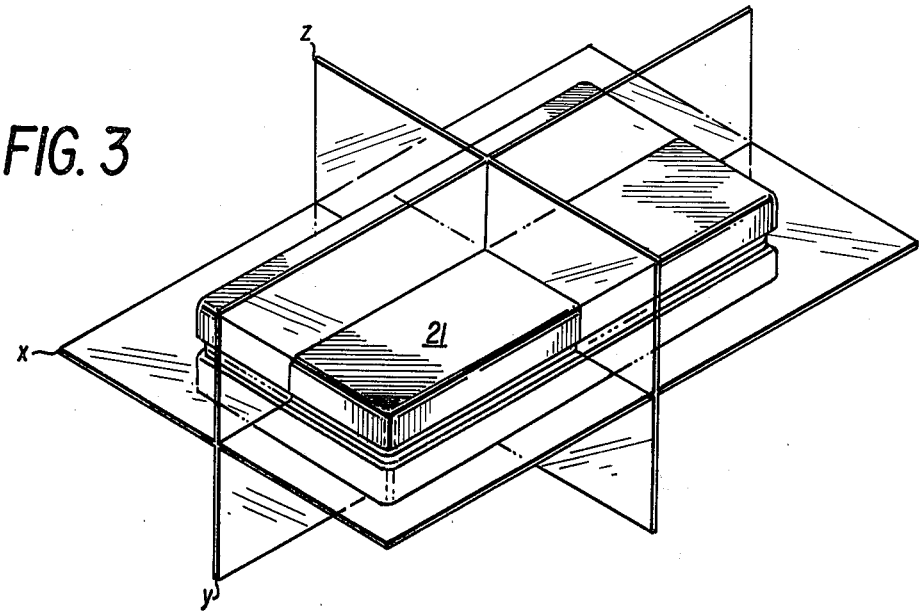
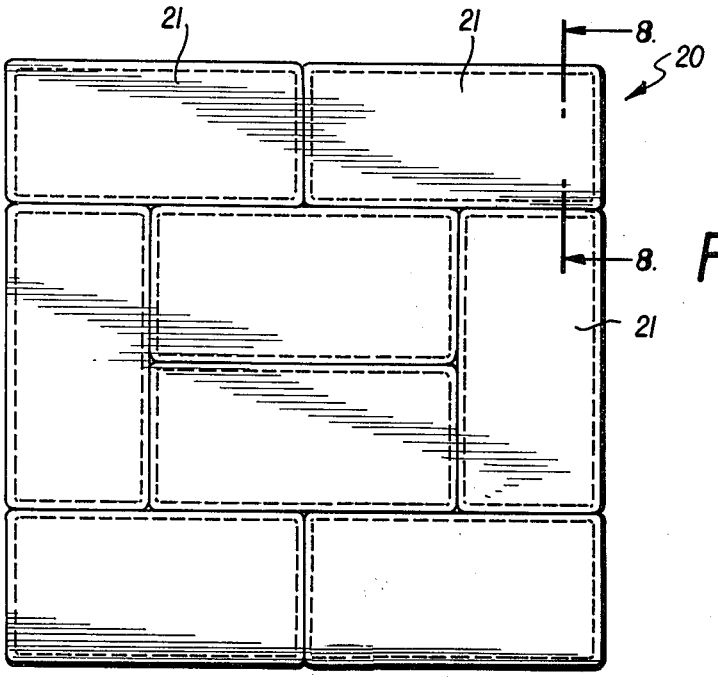
FIG. 1

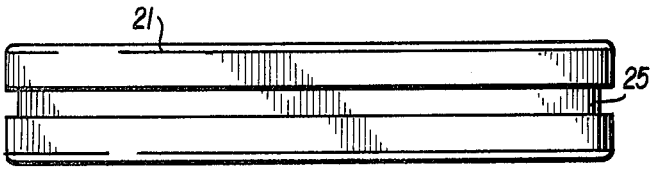
FIG. 4
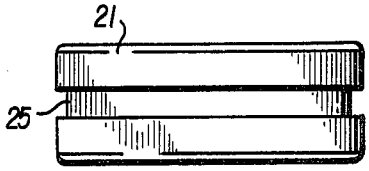
FIG. 5
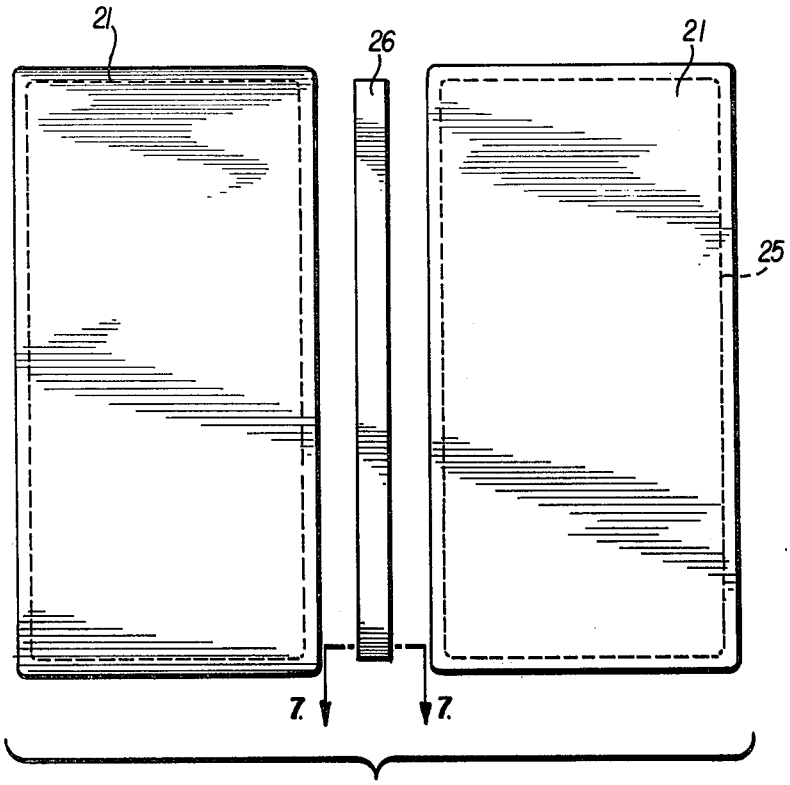
FIG. 6
FIG. 7
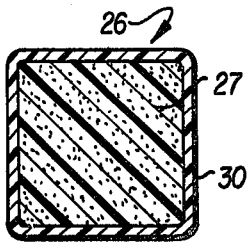
FIG. 8
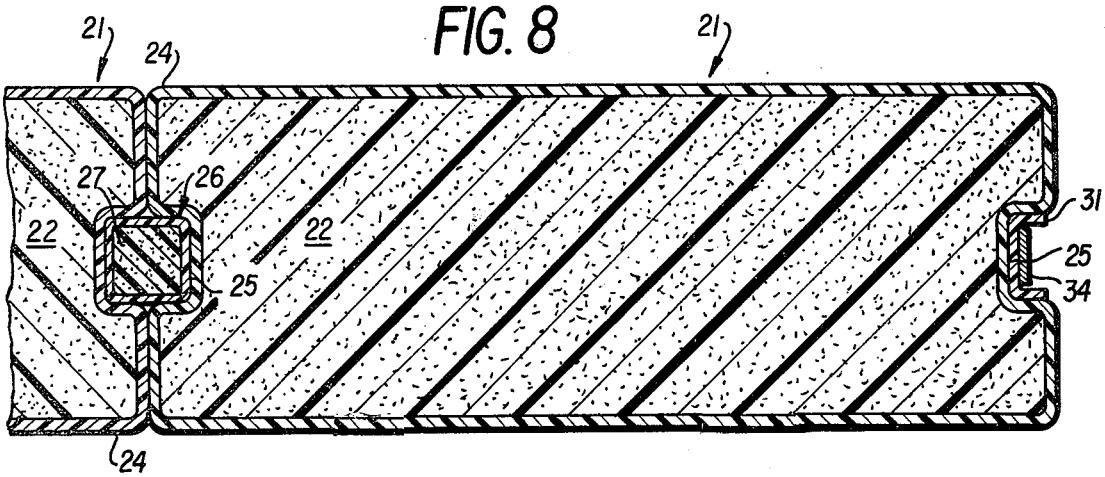

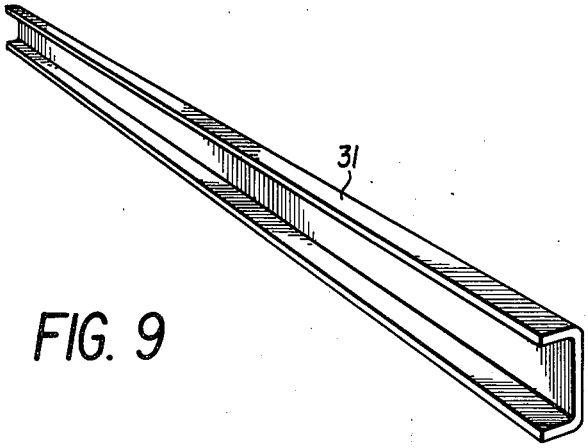
FIG. 9
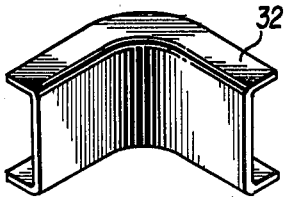
FIG. 10
FIG. 11
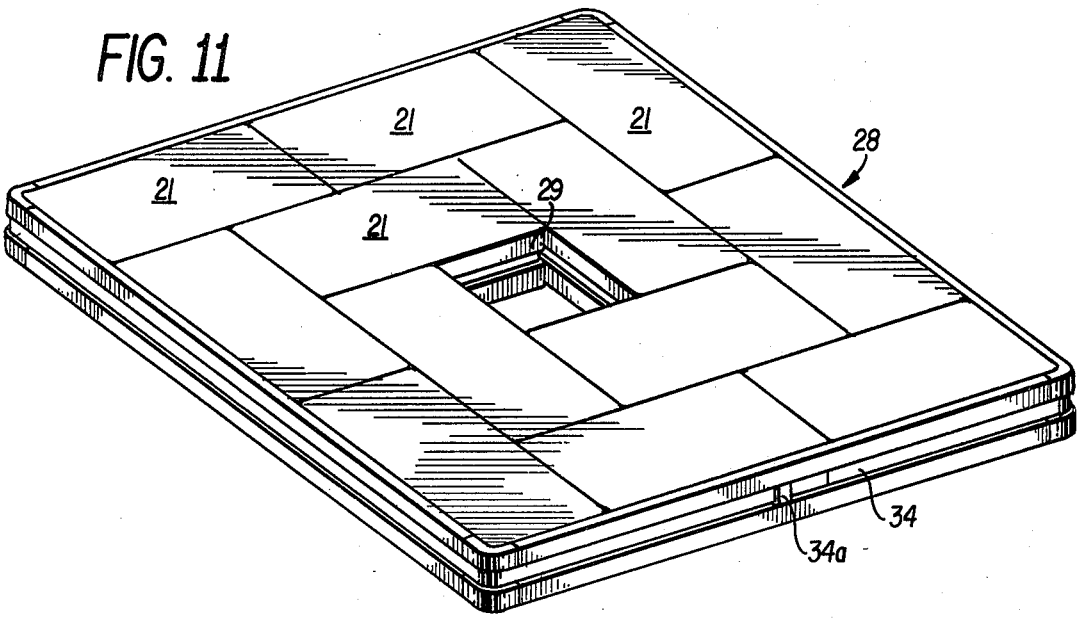
FIG. 13
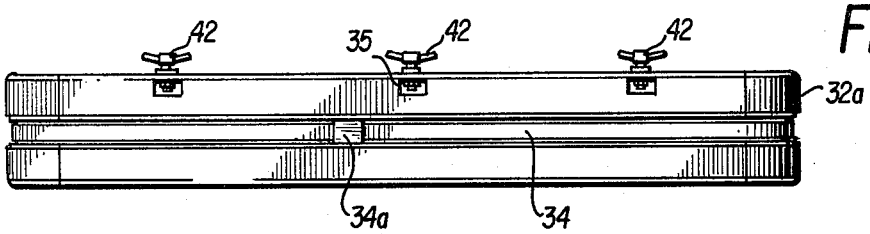

MODULAR FLOATING LOAD-SUPPORTING ASSEMBLAGE

BACKGROUND OF THE INVENTION

The invention relates to floating load-supporting structures and, more particularly, to such structures which are comprised of a plurality of similar parallelepiped modules composed primarily of an expanded polystyrene plastic or the equivalent.

Description of the Prior Art

Numerous types of floating wharves, docks and the like have been devised for use in lakes, rivers and the sea. The vast majority of floatable structures of this type are large and bulky — usually a monolithic type structure — whereby their removal or storage may constitute a major undertaking. It is known that this problem is avoidable through the employment of individual floating modules. For example, U.S. Pat. No. 3,091,203 is directed to joined units which include flanges surrounding same. In the U.S. Pat. No. 3,022,759, rods or cables under tension hold concrete pontoons together under compression. A pier and raft construction is disclosed in U.S. Pat. No. 3,152,568 whereby frames for floating structures may be connected together in various combinations. U.S. Pat. No. 3,546,773 relates to the fabrication of a plurality of modules formed from polymer foam, such modules being assembled in an edge-to-edge relationship and held together by a plurality of cables received in passages through the modules.

However, each of the foregoing embodiments entails certain complexities in the assemblying of the structures particularly by one or two individuals without special skills. A need therefore exists for a floatable load-supporting structure which can be assembled and disassembled rapidly, which is relatively inexpensive and at the same time is adaptable to somewhat abusive treatment, the structure being primarily intended for fresh water resorts and for individual homes and cabins on lakes or rivers. More specifically, the need is for such a structure which can be assembled easily in the Spring of the year and disassembled, transported and stored without difficulty subsequently in the Fall, all accomplished manually without requiring tools of any kind, and which can be enlarged without difficulty with parts receiving substantial wear being capable of removal and replacement at minimal cost and inconvenience.

SUMMARY OF THE INVENTION

The invention is basically directed to a floatable load-supporting structure which constitutes an assemblage of box-shaped parallelepiped modules. Each module is preferably identical and is composed primarily of a plastic foam material such as that known as styrofoam. Such a module may be manufactured by any of a number of techniques as, for example, are outlined in U.S. Pat. No. 3,546,773, to which prior reference is made. The method of fabriation of the module of the invention does not, as such, form part of the invention. Each module is substantially or entirely encapsulated in a shell or skin which is preferably a plastic fibrous impervious material such as fiberglass applied in a catalyzed resin. Centered and extending completely around the periphery of each module is a groove which is defined by the body of the module to comprise a rectangular space as seen in section. In the floating structure, adjacent modules are joined by a snugly fitting rod of rectangular configuration which is received in both grooves. Preferably, such rods are of the same construction as the module having an outer skin applied over a plastic foam material. A plurality of like modules are joined together by the rods until formed into an assemblage of the desired dimensions. Then a plurality of channel beams are fitted in the outboard facing channels of the modules to form an aligned outboard facing channel completely around the periphery of the assemblage. Such channel receives a tension band which is somewhat resilient and held in a condition of tension by a toggle or other appropriate connection. If desired, the peripheral pieces can be larger to form a complete protective edge about the perimeter of the assemblage of modules to which attachments such as cleats and the like for tying a boat alongside may be attached.

Other capabilities and adaptabilities of the invention will be appreciated by those skilled in the art with reference to the following description and drawings.

BRIEF DESCRIPTION OF THE DRAWINGS

FIG. 1 is a plan view of an assemblage of modules in accordance with the invention;

FIG. 2 is a side elevation of the assemblage shown in FIG. 1;

FIG. 3 is a perspective view of a module in accordance with the invention with planar axes of the module indicated;

FIG. 4 is a side elevational view of the module shown in FIG. 3;

FIG. 5 is an end elevational view of the module shown in FIGS. 3 and 4;

FIG. 6 is a plan view of two modules and intervening connecting bar in accordance with the invention;

FIG. 7 is a sectional view of the connecting bar taken on section lines 7—7 of FIG. 6;

FIG. 8 is a sectional view taken on lines 8—8 of FIG. 1 which further illustrates the mechanism for the interconnection of modules in accordance with the invention;

FIG. 9 shows in perspective a channel bar which is part of the connecting mechanism of the invention;

FIG. 10 is a perspective view of a corner piece which constitutes a still further part of the connecting mechanism;

FIG. 11 is a perspective view of a further embodiment of the invention;

FIG. 13 is a side elevational view of the assemblage shown in FIG. 12;

DESCRIPTION OF THE PREFERRED EMBODIMENTS

Figure 12:
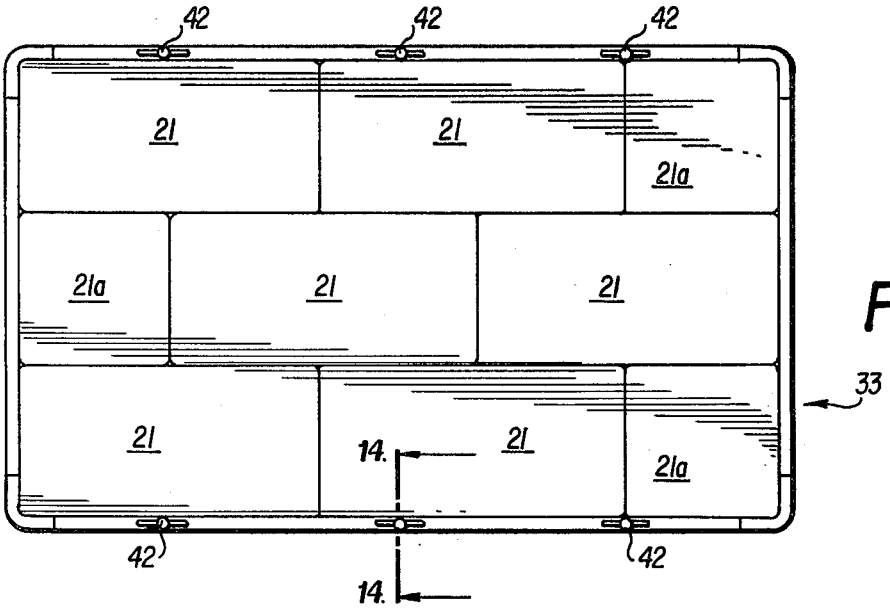
FIG. 12 is a plan view of a variation of the embodiment disclosed in FIG. 11 which includes a lesser number of modules.

Referring in particular to FIGS. 1–10, it is to be seen that a load-supporting loading structure which is designated generally by reference numeral 20 comprises an assemblage of parallelepiped modules 21 each consisting of an interior 22 composed of plastic foam material such as styrofoam completely encapsulated in shell or skin 24 which is preferably a plastic fibrous impervious material such as fiberglass applied in a catalyzed resin. This skin is applied to protect each module from wear due to weather and water conditions, use and the like. Each module 21 has formed about its periphery a groove 25 which, when two or more modules are floating in an adjacent side-by-side relationship their respective grooves 25 face each other in contraposition. Each groove 25 is of a size and shape to receive snugly a connection bar 26 which preferably is composed of the same materials as module 21, the connecting bars' skin 30 being similarily applied thereto over an expanded polystyrene plastic core 27 as a protective coating.

A plurality of modules 21 are joined together by placing two or more of such modules in juxtaposition and with the connecting bar 26 being fitted into both adjacent juxtaposed grooves 25. This procedure is repeated until a floatable assembly 20 of the desired dimensions is obtained. Each connecting bar 26 may be of the same length as the groove 25 along module 21 or, optionally, may be longer up to the width or length, whichever is longer, of the completed floatable assemblage. It is to be noted from FIGS. 4 and 7 that the connecting bar 26 has a rectangular cross-section. Its height is substantially the same as the interior height defined by groove 25 and its width is substantially double the horizontal depth of each groove 25.

To maintain the entire assemblage 20 in a rigid relationship, peripheral pieces comprising channel bars 31 and corner pieces 32 are placed into the outboard exposed grooves 25 which extend completely around the perimeter of the otherwise completed assemblage. Pieces 31 and 32 are preferably composed of the same material as skin 24 and 30 of modules 20 and connecting bars 26 — that is of a fiberglass structure. At the same time, they should be floatable and thus may be provided with a plastic foam or honeycomb core sufficient for the purpose as would occur to one skilled in the art. As will be noted from FIGS. 2, 8 and 9, each channel bar 31 is concave on its outboard side as is each corner piece 32 shown in FIG. 10. Received in the channel about the periphery of the assemblage 20, which is formed through the alignment of the channel pieces 31 and corner pieces 32, is a tension band 34 extending around the entire perimeter of the floatable assemblage 20. Such tension band 34 is preferably composed of a material having a high tensile strength, which is corrosive resistant, durable and impervious to water and other fluids dissolved therein and otherwise found in the water of lakes, rivers and the sea. For example, band 34 may be composed of stainless steel coated with an inert light weight elastic type plastic. Band 34 is fastened tightly in a state of tension about the perimeter of the assemblage by suitable fastening or securing means 34*a* which may be a buckle, toggle or the like.

It will be noted from FIG. 10 that the peripheral or corner piece 32 is essentially a curved version of the channel bar 31 with substantially the same profile and formed so that it is snugly received in two intersecting grooves of the modules 21 located at the corners of assemblage 20. Inasmuch as the corner piece 32 is received for a short distance in each of the intersecting grooves 25, it will be appreciated that the length of each channel bar 31 is modified accordingly to be somewhat less than the width of the corresponding module or side of the assemblage where it is received in groove 25.

Figure 14:
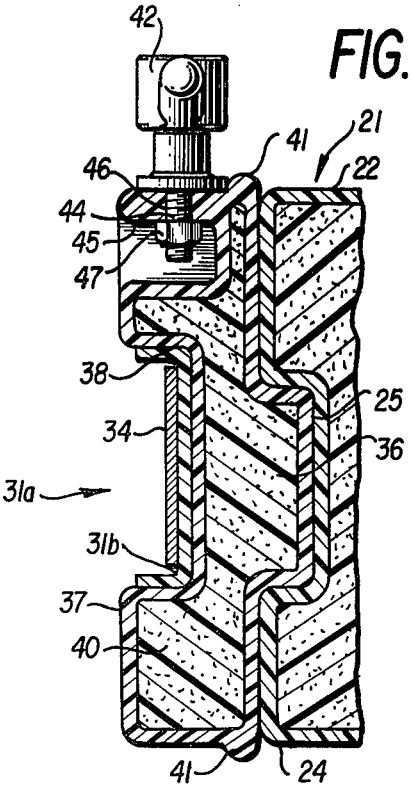
FIG. 14 is a cross-sectional view taken on lines 14—14 of FIG. 12.
Figure 15:
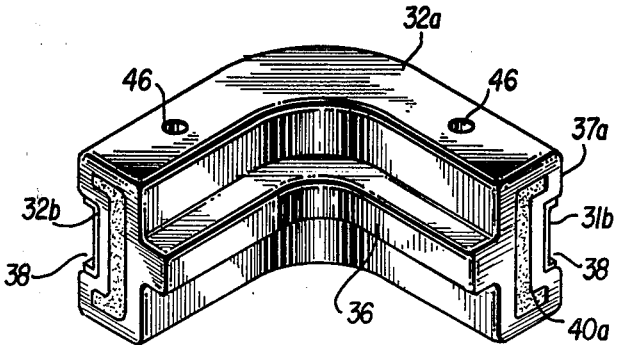
FIG. 15 shows in perspective a corner piece which is part of the connecting mechanism in the embodiment illustrated in FIGS. 11–14.

The modules 21 and pieces 31 and 32 may be provided in a variety of sizes and shapes to permit the assembling of a floatable load-supporting structure of a multiplicity of different geometric module forms appropriate to the intended use. But the preferable basic block size for each module 21 is about 1-foot in height by 2-feet in width by 4-feet in length. With modules of such size, further modules which are 1 × 2 × 2 feet may be provided to complete certain raft or dock assemblage designs. For example, in FIG. 11 an assemblage 28 is shown which is comprised of a plurality of modules 21 which leave a rectangular space 29. The space 29 may, if desired, be left open, or alternatively, filled with a 1 × 2 × 2 feet module. The embodiment shown in FIG. 12 contains three such modules designated 21*a*. The assemblages 28 and 33 shown in FIGS. 11, 12 and 13 also have a distinctive peripheral structure. This structure in FIG. 12 shows in a plan view a somewhat different arrangement of modules 21 and 21*a* which comprise the assemblage 33 and indicate the versatility of the system in accordance with the invention. In these embodiments (FIGS. 11–13), a straight edge protector piece 31*a* is provided which is shown in FIG. 14 in cross-section and an perspective view a corner protective piece 31*a* for the same embodiments is shown in FIG. 15. Each protector piece 31*a* has a midway longitudinally extending tongue 36 which, in the same manner as channel piece 31, is received snugly in the groove 25 of each module as exposed to the periphery of the assemblages 28 and 33. Pieces 31*a* and 32*a* are each provided with a foam plastic core 40 and 41*a*, respectively, and with exterior plastic skins 37 and 37*a*, respectively. In both instances to provide improved protection, the skin is preferably thicker than that shown in the embodiment of FIGS. 1–10 for the modules 21 and, in view of its position on the edge of the assemblage, the corner piece 32*a* has a still thicker skin 37*a* and thus a relatively smaller core 40*a* in cross-section than the straight protector piece 31*a*. Nevertheless, both pieces, 31*a* and 32*a* have a sufficiently low average density whereby they are floatable. In the straight pieces, profiled portions 41 may be incorporated whereby the resulting assemblage has a rim comprised of continuous aligned profiled portions 41 about its periphery.

To permit connection of accessories and parts normally utilized on floating structures of the type involved, a thickened rigid plastic portion 45 with appropriate strength characteristics may be provided on pieces 31*a* and 32*a*. In each thickened plastic portion 45, an opening 46, preferably threaded, is provided to receive a threaded shaft 44 of a part 42 such as a bit or cleat or other appropriate part such as a rod for railing or the like. A nut 47 may be received on shaft 44 to ensure a positive firm connection of part 42. Each piece, 31*a* and 32*a* has an outboard profiled inset 38 which receives a channel bar 31*b*. These channel bars 31*b* are each similar to that shown in FIG. 9 except that they have a greater height. Channel bars 31*b* are received in the inset 38 completely around the periphery and may include in a corresponding profiled inset 38 of corner piece 32*a* a further corner channel bar 32*b* similar to piece 32 shown in FIG. 10 but having the same profile as the channel bar 31*b*. Such corner channel bars 32*b* and straight channel bars 31*b* are placed in the inset portions 38 to surround completely the assemblages shown in FIGS. 11, 12, and 13 and in turn receive a tension band 34 similar or identical to that disclosed in reference to FIGS. 1–10.

Preferably each module 21 as shown in FIGS. 3, 4 and 5 is manufactured whereby the groove 25 is centered between the top and bottom of the module. Visualizing the module 21 as cut by solid plane axes or coordinants *x*, *y* and *z* as shown in FIG. 3, the half of the module as divided by any one of such co-ordinates is a mirror image of the other half. Thus the top and bottom as well as the front and back and sides of each module 21 are interchangeable which has the effect of permitting a considerably prolonged wear life of each module and assemblage as such inasmuch as the surfaces receiving the greatest wear can be reversed each time the assemblage is assembled or otherwise as desired.

The connecting bars 26, the channel bars 31 and 31*b* and the edge pieces 31*a* are preferably provided in lengths which may be as long as practical whereby they can be shortened by sawing or otherwise cutting them as desired for the particular design assemblage to be constructed. In this connection it will be understood that assemblages may be elongated or otherwise enlarged by subsequently adding further modules and using additional connecting mechanisms of the type disclosed herein. Moreover, with the same basic module being utilized together with the same connecting bars 26 and channel bars 31, each assemblage may be enlarged or the shape of same modified from time to time without incurring undue expense.

In storing the modules at, say a summer home on a lake, during the off seasons, the modules are adapted to be reconnected in an attic or along a wall of the summer cottage in such a manner as to provide insulation which will assist in retaining warmth in the cottage should it be used in cold weather.

Still further, although the system has not been designed for the specific purpose of life saving in the event of a marine disaster, the light weight of the components which constitute each assemblage and the adaptability of the components to be assembled in different plan dimensions suggest a possible adaptation of one or several assemblages to being placed over part of an upper weather deck of a marine vessel as a secondary life-sustaining means should the vessel sink rapidly without warning, whereby its life boats could not be launched, so that the assemblage would, due to its buoyance float off the vessel as it submerges. Should an assemblage break up under adverse sea conditions, it might still be possible for survivors to reassemble floating structures from the floating components. Moreover, by providing shells 24 with a contrasting radar and light reflective material, the location of the sinking and survivors would be more readily discovered by searching aircraft and ships.

Having described my invention, what I claim as new and novel and desire to secure by Letters Patent of the United States is:

1. A floatable load-supporting structure adapted for ease of assembly and disassembly which comprises:

a. a plurality of floatable box-shaped modules disposed in juxtaposition;

b. each said module being provided with a groove about its periphery whereby said grooves in adjacent modules are in contraposition;

c. bars received in said contrapositioned grooves of adjacent modules whereby such adjacent modules are joined by said bars;

d. said joined modules forming a closed polygonal figure having a plurality of sides as seen from above with those grooves of said grooves which face outboard relative said figure providing a continuous channel around the perimeter of said figure; and e. a continuous tension band provided in said channel around said perimeter, said band being in a state of tension whereby said modules are pressed together into an essentially rigid platform structure.

2. A structure in accordance with claim 1, wherein said grooves and bars are substantially rectangular in cross-section.

3. A structure in accordance with claim 2, wherein said channel receives channel bars, said band being received in a further continuous channel formed by said channel bars about the periphery of the polygon comprised of said modules.

4. A structure in accordance with claim 3, wherein said polygon figure comprises a rectangle.

5. A structure in accordance with claim 1, wherein each of said modules has an identical configuration.

6. A structure in accordance with claim 5, wherein each of said modules has a length of about 4 feet, a width of about 2 feet and a height of about 1 foot.

7. A structure in accordance with claim 1, wherein each of said modules is composed principally of a foam-type material.

8. A structure in accordance with claim 7, wherein each of said modules is provided with a shell composed essentially of a substantially water impervious material.

9. A structure in accordance with claim 1, wherein said channel receives protective edge pieces, said edge pieces providing a further outboard continuous channel about the periphery of said polygon formed by said module.

10. A structure in accordance with claim 1, wherein said modules each have a shape whereby when bisected through its center by a flat plane parallel to any one of its sides each half of the module on either side of said plane is a mirror image of the other half.

* * * * *